US007934849B2

(12) United States Patent
Ellis et al.

(10) Patent No.: US 7,934,849 B2
(45) Date of Patent: May 3, 2011

(54) RECHARGEABLE LAMP SYSTEM WITH LAMP UNIT AND DOCKING STATION

(75) Inventors: Peter John Ellis, Rozelle (AU); Chi Kin Chan, Rozelle (AU)

(73) Assignee: Neoz Pty Ltd, Rozelle, New South Wales (AU)

( * ) Notice: Subject to any disclaimer, the term of this patent is extended or adjusted under 35 U.S.C. 154(b) by 292 days.

(21) Appl. No.: 12/067,327

(22) PCT Filed: Sep. 13, 2006

(86) PCT No.: PCT/AU2006/001345

§ 371 (c)(1),
(2), (4) Date: Jul. 18, 2008

(87) PCT Pub. No.: WO2007/033406

PCT Pub. Date: Mar. 29, 2007

(65) Prior Publication Data

US 2009/0303702 A1 Dec. 10, 2009

(30) Foreign Application Priority Data

Sep. 26, 2005 (AU) ..... 2005905295

(51) Int. Cl.
*F21L 4/08* (2006.01)

(52) U.S. Cl. ..... 362/183; 362/205; 362/249.12

(58) Field of Classification Search ..... 362/183, 362/202, 205, 206, 249.02, 249.12, 186, 362/191, 102; 257/89
See application file for complete search history.

(56) References Cited

U.S. PATENT DOCUMENTS

| | | | | | |
|---|---|---|---|---|---|
| 377,340 | A | * | 1/1888 | Urquhart et al. | 362/186 |
| 2,224,742 | A | * | 12/1940 | Muldoon | 362/202 |
| 2,668,228 | A | * | 2/1954 | Levinson et al. | 362/20 |
| 3,767,911 | A | * | 10/1973 | Oakley et al. | 362/186 |
| 3,873,979 | A | * | 3/1975 | Craford et al. | 340/815.45 |
| 3,987,401 | A | * | 10/1976 | Irving | 116/263 |
| 4,096,553 | A | * | 6/1978 | Roche | 362/183 |
| 4,286,310 | A | | 8/1981 | Brainkel et al. | |
| 4,329,740 | A | | 5/1982 | Colvin | |
| 4,605,993 | A | * | 8/1986 | Zelina, Jr. | 362/183 |
| 4,782,432 | A | * | 11/1988 | Coffman | 362/184 |
| 5,465,196 | A | | 11/1995 | Hasenberg et al. | |
| 5,588,739 | A | | 12/1996 | Nakao | |
| 5,754,124 | A | * | 5/1998 | Daggett et al. | 362/183 |
| 6,280,874 | B1 | | 8/2001 | Hensley et al. | |

(Continued)

FOREIGN PATENT DOCUMENTS

DE 298 00 936 5/1998

(Continued)

*Primary Examiner* — Ismael Negron
(74) *Attorney, Agent, or Firm* — Michael J. Striker

(57) ABSTRACT

A lamp unit includes a base having a Reed switch, a telescopic stem extending upwardly from the base, a light source fitted at the top of the step, and a rechargeable battery fitted around the stem and below the light source. A docking station includes one or more magnets, an upstanding ring, and positive and negative contacts disposed in the center of the upstanding ring. The base of the lamp unit defines an aperture configured to be positioned over the circular ring so that the lamp unit may rotate on the docking station. Rotation of the lamp on the docking station is arranged such that the magnets actuate the Reed switch for turning the light source ON or OFF.

18 Claims, 9 Drawing Sheets

U.S. PATENT DOCUMENTS

| | | | | |
|---|---|---|---|---|
| 6,304,060 | B1 * | 10/2001 | Dernehl | 320/132 |
| 6,428,925 | B1 | 8/2002 | Takeno et al. | |
| 6,819,080 | B2 * | 11/2004 | Barbeau et al. | 320/107 |
| 7,726,860 | B2 * | 6/2010 | Harrity et al. | 362/555 |
| 2005/0057934 | A1 | 3/2005 | Chen | |

FOREIGN PATENT DOCUMENTS

| | | |
|---|---|---|
| GB | 2 107 446 | 4/1983 |
| GB | 2 112 572 | 7/1983 |
| GB | 2 388 653 | 11/2003 |
| WO | 94/04867 | 3/1994 |

* cited by examiner

RECHARGEABLE LAMP SYSTEM WITH LAMP UNIT AND DOCKING STATION

CROSS-REFERENCE TO RELATED APPLICATIONS

The present application claims priority from Australian Provisional Patent Application No 2005905295 filed on 26 Sep. 2005, the content of which is incorporated herein by reference.

FIELD OF THE INVENTION

This invention relates to an improved lamp system particularly for cordless lamps.

BACKGROUND OF THE INVENTION

It is known to utilise electrically operated or battery powered lamps producing low levels of ambient light, for example, in the restaurant and hospitality industry in place of candles.

However, existing cordless lamps have a number of problems.

The first problem is that existing cordless lamp systems require recharging quite frequently and typically cannot be recharged at the same time as they are in use providing illumination. Hence, at the end of an evening at a restaurant or other venue at which the lamps have been used, is necessary to remove all the cordless lamps from the restaurant/venue's tables and plug them into re-chargers for use the following day.

A second issue with existing cordless lamps is they all tend to look very similar having a typically ovoid diffuser/glass cover to produce a diffuse low level light source. Many modern restaurants and other venues now focus heavily on aesthetics and design not only in the interior decoration of the venue itself but in the design of the crockery and cutlery and would benefit from a cordless lamp system which allowed for the provision of different lamp covers complementing the overall design and ambience of the restaurant or other venue.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

In a first aspect of the present invention there is provided a rechargeable lamp system comprising a lamp unit and a docking or charging station which may be connected to a source of electrical power and on which the lamp unit may be placed for charging of a rechargeable power source within the lamp unit, wherein the configuration of the base of the lamp unit and the docking unit is such that the lamp unit may be rotated on the docking station and wherein the rotation of the lamp on the docking station is arranged to operate switches for turning a light source within the lamp unit ON or OFF.

This arrangement allows the lamp unit to be used either on or off the docking station with a simple to operate and non-visible switching mechanism.

Typically, the docking station will define an upstanding ring in the centre of which are located positive and negative contacts and the base of the lamp defines a aperture which locates over the circular ring so that the lamp unit may rotate on the docking station.

When ON, the lamp may include a variable preset brightness setting.

In a particularly preferred embodiment, one or more magnets are provided in the docking station and a reed switch is provided adjacent the base of the lamp unit, in an arrangement such that rotation of the lamp causes the magnet to come into close proximity with the reed switches, switching the reed switch ON and providing an input to a microcontroller which controls the operation of the lamp.

In a second aspect of the present invention, there is provided a battery powered lamp unit including a base, a stem upstanding from the base, and a light emitting device, such as a lamp bulb, disposed at the top of the post, and a battery assembly which may comprise a plurality of batteries or cells, wherein the battery assembly defines a central aperture which in use, fits over and around the stem so that the battery is located above the base surrounding the stem and below the light emitting device.

The provision of the battery pack having a central aperture around the lamp post makes for efficient use of space in the cordless lamp and also makes it relatively easy for the battery to be changed by simply disconnecting the battery pack by simply removing any cover or shade over the lamp unit, disconnecting the battery pack and slipping it over the top of the stem.

In a particularly preferred embodiment, a control circuit for the lamp is located in a cavity defined in the base of the lamp unit underneath the battery.

This arrangement allows the lamp unit to be relatively compact and at the same time, utilise a relatively large but easily accessible battery pack providing a relatively long illumination period between recharges depending on the degree of illumination of the lamp.

In a preferred embodiment, a retention clip is provided which snap fits over the top of the battery and retains the same against the post to secure the battery to the post and lamp base.

The base may define a illuminable indicator means which changes colour (preferably by the switching ON or OFF of various coloured LED's) depending on the status of the lamp and docking station. In particular, the illuminable indicator means will glow blue when power is supplied to the docking station, changes to red when the lamp unit is properly docked with the docking station and is charging and/or the light emitting device is switched ON, and will turn to green when the lamp is fully charged. The switching of the various LEDs may be controlled by a circuit measuring the current supply to the lamp unit.

In a yet further embodiment aspect of the present invention, there is provided a cordless lamp unit comprising a base and a post extending upwardly from the base defining a light emitting device on the top of the post or a socket for receiving such a device characterised in that the post is extendible between a first length and second relatively longer length.

By making the stem extendible in this manner, it becomes possible to utilise lamp covers/diffusers having different sizes and designs, with the height of the lamp being readily adjustable to suit different sizes and shapes of diffusers/shades.

BRIEF DESCRIPTION OF THE DRAWINGS

A specific embodiment of the invention will now be described, by way of example only, and with reference to the accompanying drawings in which.

DETAILED DESCRIPTION OF PREFERRED EMBODIMENT

Figure 1A:
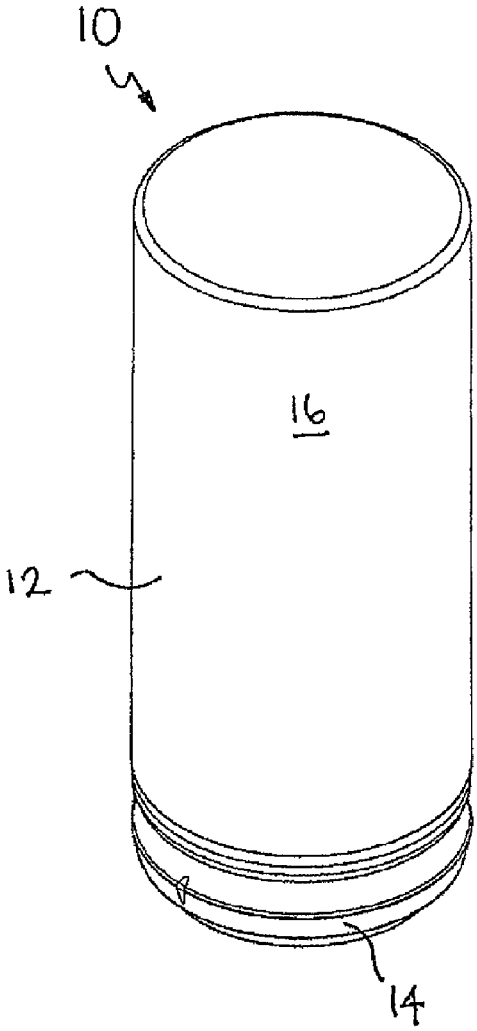
FIGS. 1*a* and 1*b* show an assembled lamp unit located on, and separated from, a docking station, respectively.
Figure 1B:
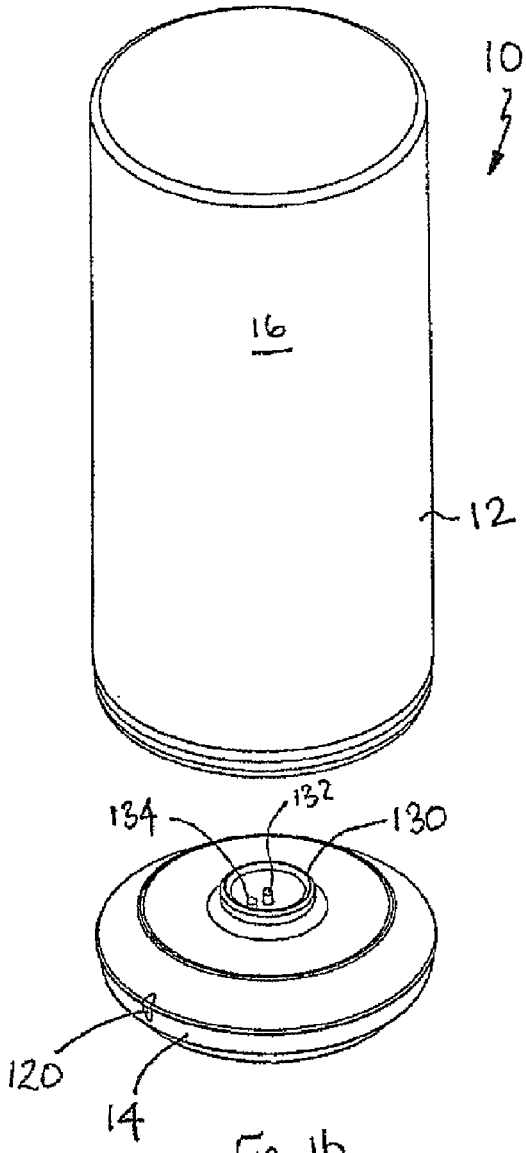

Referring to the drawings, FIGS. 1*a* and 1*b* show a rechargeable cordless lamp system 10 embodying the present invention. The system comprises a lamp unit 12 and a docking/charging station 14. The lamp unit includes a frosted glass diffuser/lamp shade 16 although other translucent materials may be used. The components of the system are generally circular in plan view although variants may have different shapes.

Figure 2:
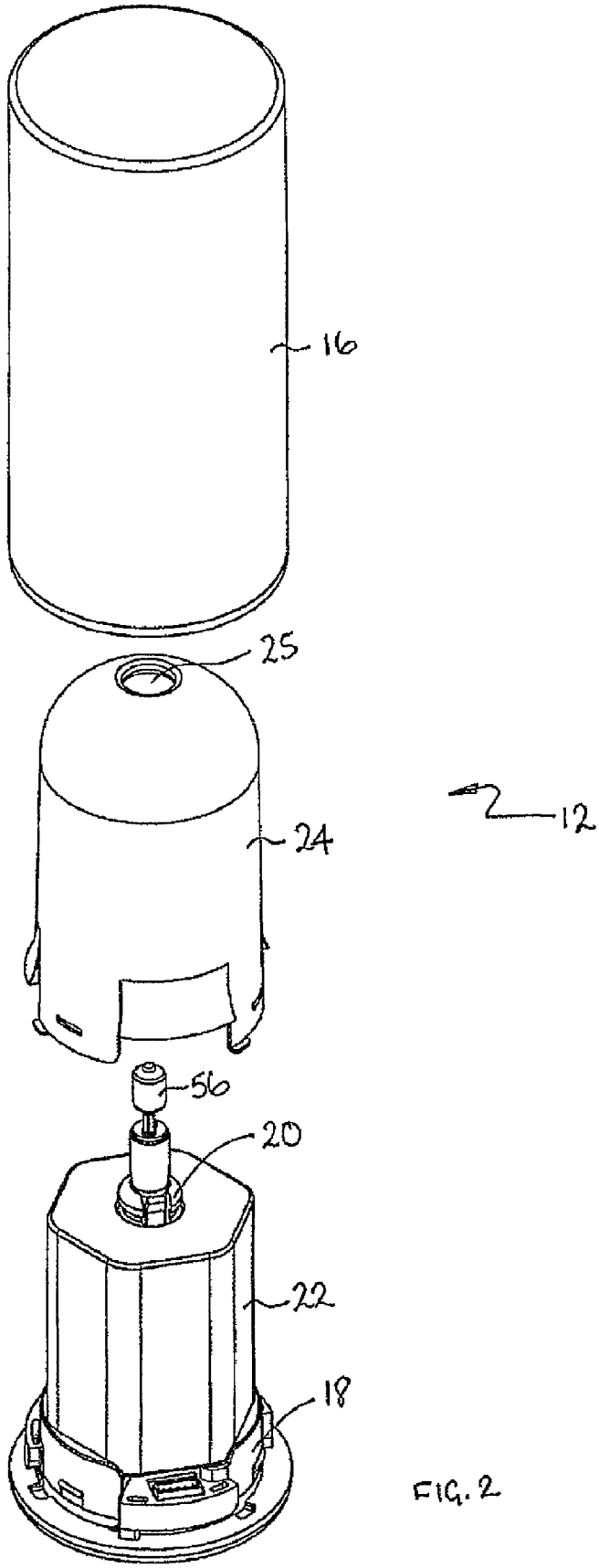
FIG. 2 is an isometric view of an embodiment of a lamp unit of the present invention shown in part-exploded view.

FIG. 2 is an exploded view showing the components which make up the lamp unit 12 in more detail. In particular, the lamp unit includes a first component comprising a base 18 and integral stem/pillar 20 on which a battery assembly in the form of a battery pack 22 is mounted. The bottom of the battery pack is received in a recess defined in the base 18, to be described in more detail below. A shaped cover 24 which defines a centrally located aperture 25 fits over the battery and snap or push fits to the base. The top of the stem 20 projects through the aperture 25. The cover 24 hides the battery pack and associated cabling.

Figure 3:
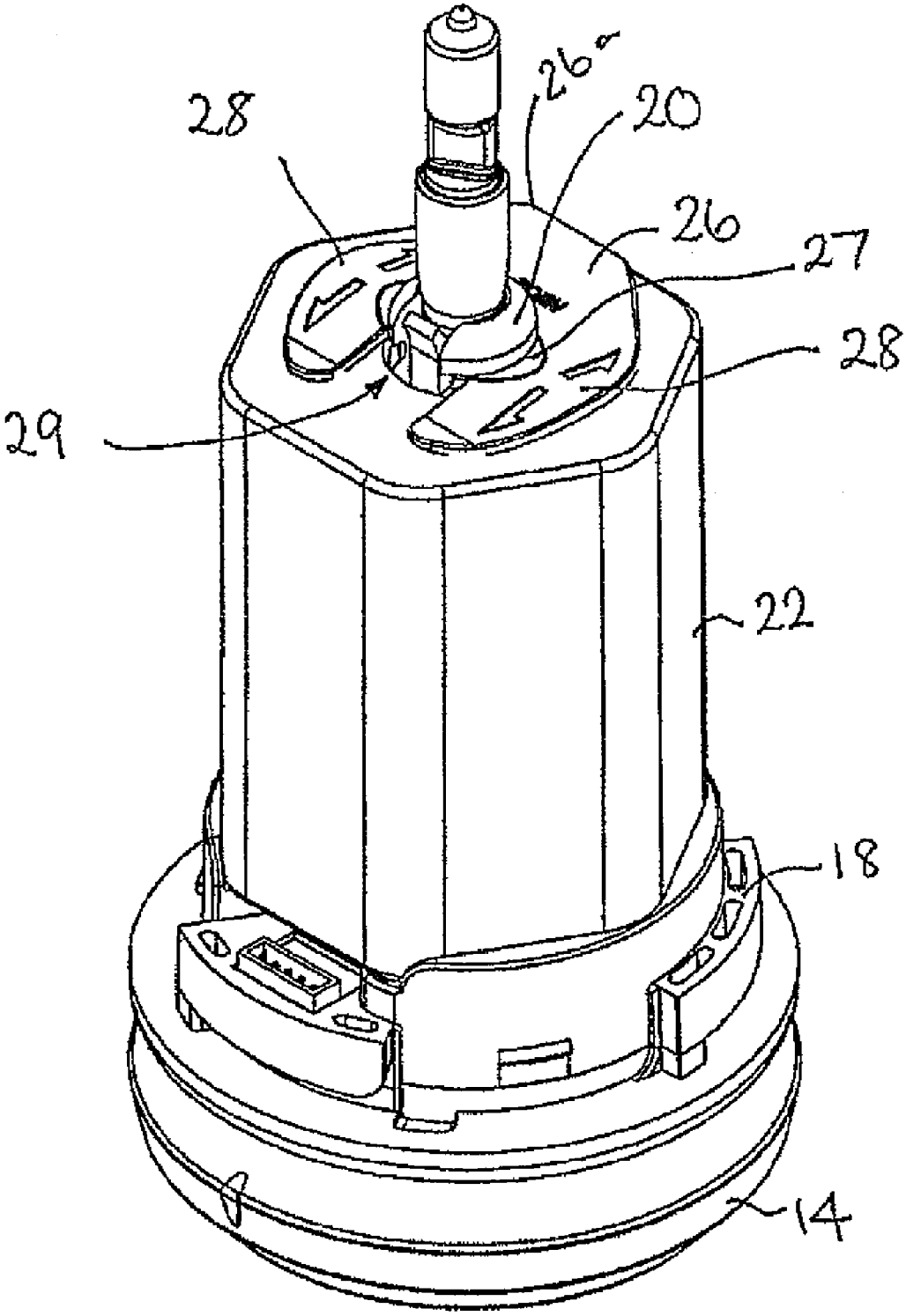
FIG. 3 is an isometric view of the lamp unit of FIG. 1 with a cover and shade removed resting on the docking station.
Figure 6:
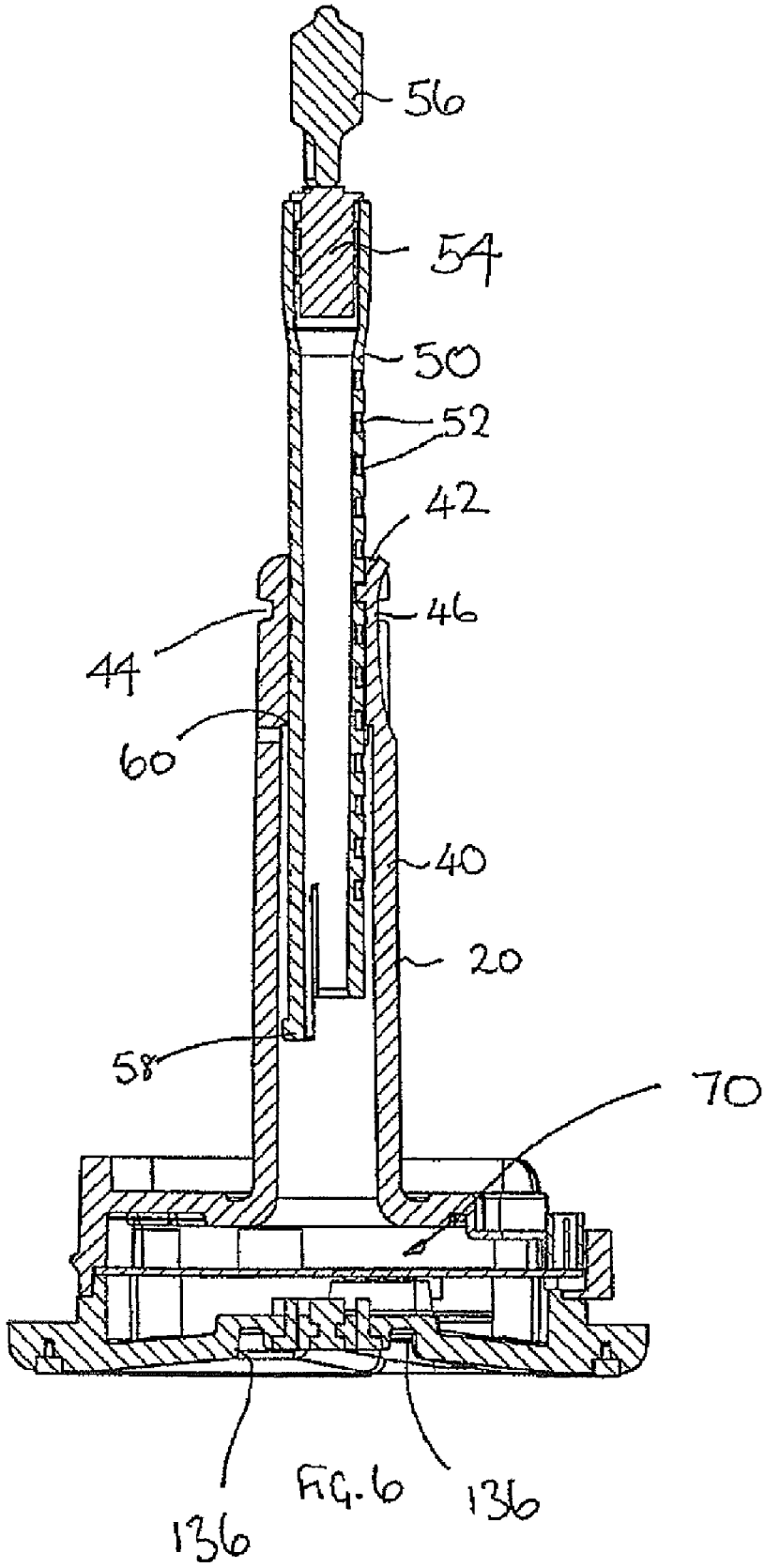
FIG. 6 is a cross section through the stem and base illustrating a stem looking mechanism in particular.

FIG. 3 illustrates the base 18 resting on the charging unit 14 and in particular, illustrates a battery retention clip 26 which snap fits to the stem 20 to help secure the battery pack to the base of the lamp unit. The retention clip 26 comprises a generally C-shaped sheet of plastic, having a generally circular central aperture 27, and side arms 28 which define a slightly tapered opening 29 which is relatively narrower compared to the central aperture. As shown, the side arms have a wavy profile, and the arms flatten as they pass around the stem, to engage that stem. In use the clip locates in a recess 44 which extends around the stem and is best shown in FIG. 6, which prevents vertical movement the retention clip relative to the stem 20. An angled portion 26*a* is provided opposite the opening to be gripped for ease of removal of the clip 26.

Figure 4:
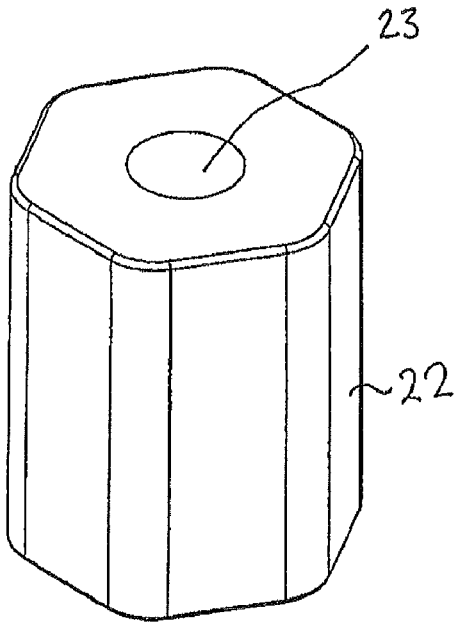
FIG. 4 illustrates the base and stem of the lamp showing a battery pack removed from the lamp.
Figure 4:
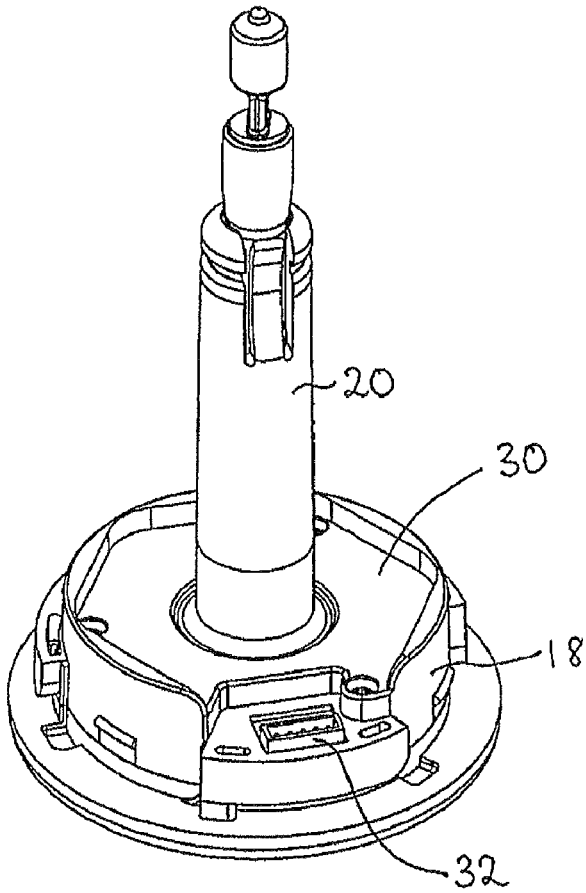

FIG. 4 illustrates how the battery pack 22 may be separated from the lamp unit. As can be seen, the battery pack 22 is generally hexagonal in plan view and defines a central, generally cylindrical, aperture 24, That aperture is sized and configured to fit over the stern 20 of the lamp unit. Also illustrated in FIG. 4 is provision of a generally hexagonal recessed portion 30 which is shaped and configured to match the cross section of the battery pack thereby receiving the bottom of the 5 battery pack when the battery pack is slotted over the stem. The shaped recess prevents rotational movement of the battery pack and helps to secure the battery pack relative to the lamp unit. Not illustrated in the drawings, is a wire and plug which would typically extend from the battery pack in order to connect the same to a socket 32 supplying power to a control circuit for the lamp unit, and allowing the battery pack to be recharged via the control circuit.

Figure 5:
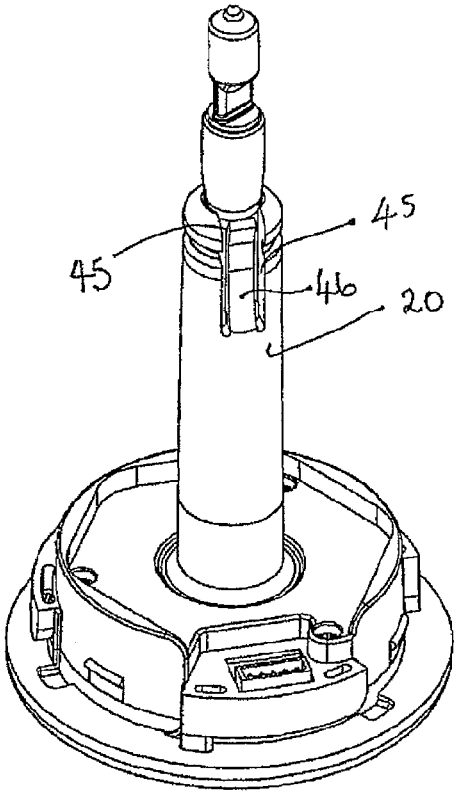
FIGS. 5*a* and 5*b* are similar views to FIG. 4 showing the stem in an unextended and extended position, respectively.
Figure 5A:
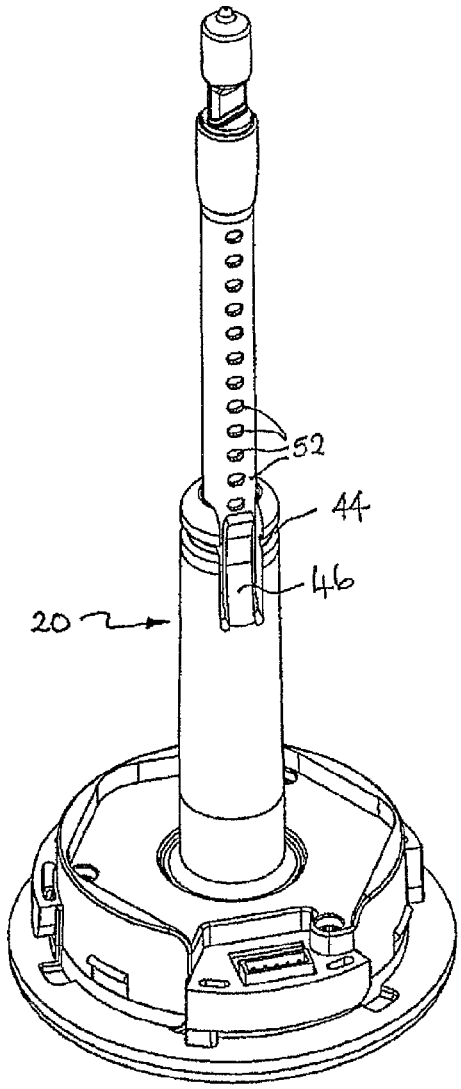
Figure 6A:
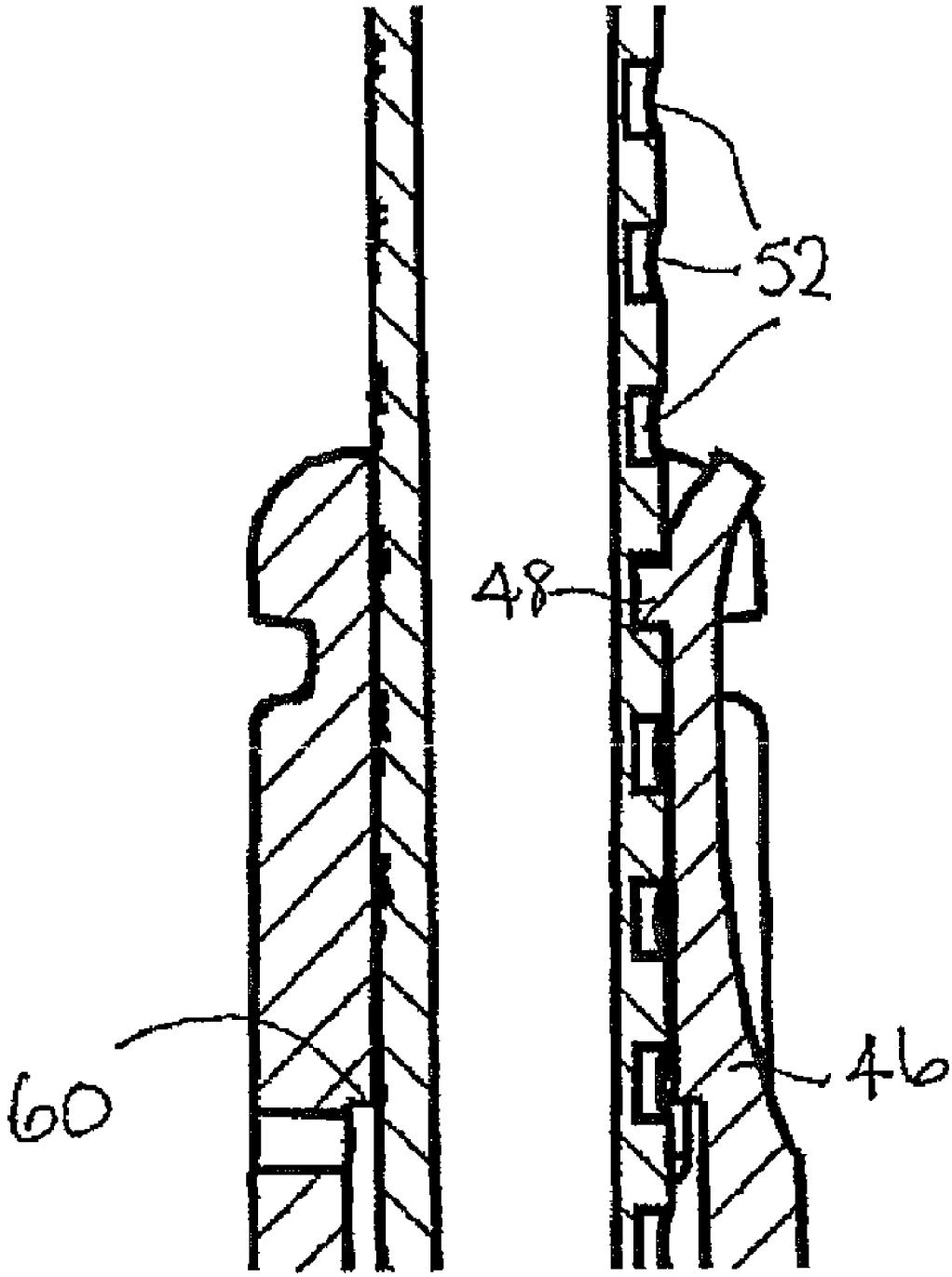
FIG. 6*a* is and enlarged view of part of FIG. 6, showing the locking mechanism in more detail.

FIGS. 5, 5*a* and FIG. 6 illustrate the telescopically extendible stem 20 of the lamp unit in more detail. The stem comprises a first column 40 which is hollow and which extends upwardly from the base and which defines an open upper end 42. A recess 44 extends around the stem close to its top in which in use, receives the retention clip 26 of the battery, not shown in FIG. 6. As shown in FIGS. 5 and 5*a* in particular, on one side of the column there are two spaced apart through slots 45 which extend down from the upper end 42 and between which a cantilevered arm 46 is defined. The base of the cantilevered arm is integral with the rest of the stem. On the face of the arm which faces the centre of the stem a projection 48, best seen in FIG. 6*a*, is defined.

Slidably located inside the column 40, is a further column 50 which is hollow and cylindrical. A series of recesses 52 are defined along one side of the stem 50. The stem 50 can be slid up and down inside the column 40 between a base position shown in FIG. 5 and a fully extended position shown in FIG. 5*a* in which a projection 58 at the base of the column 50 abuts a step 60 defined near the top of the column 40 (refer to FIG. 6). The stem is fixed in a series of discrete positions between the base and extended positions by the insertion of the projection 48 defined on the cantilever arm 46 into one of the recesses 52. At the top of the stem a socket 54 is defined which receives a light emitting device in the form of a lamp bulb 56, typically a halogen type light bulb. Not illustrated in FIG. 6 are wires passing through the centre of the columns 50 and 40 connecting the lamp to the control circuit located in the base.

Figure 7:
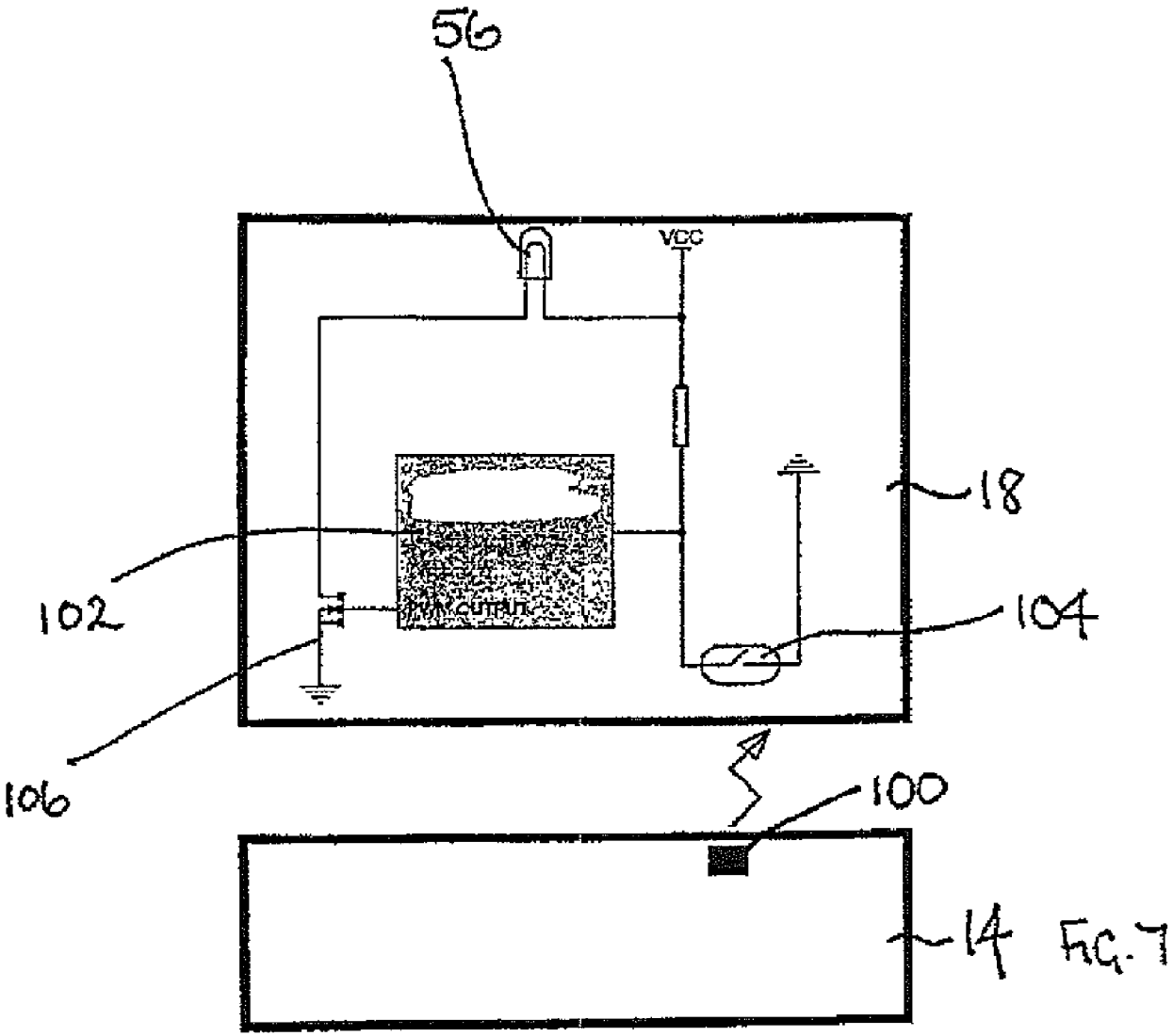
FIG. 7 is a simplified circuit diagram illustrating the principal of operation of the rotatable switching system.

Also shown in FIG. 6 is a cavity 70 defined in the base which in use receives a control unit in the form of an electronic circuit including a micro-controller 102, schematically illustrated in FIG. 7.

Figure 9:
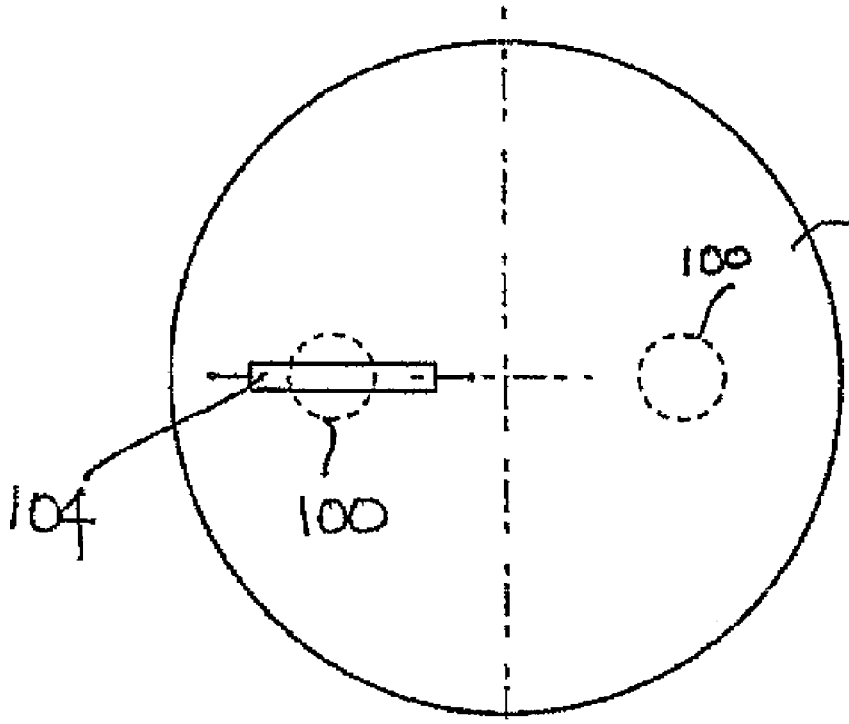
FIG. 9 is a plan view of the schematic arrangement of FIG. 8.
Figure 8:
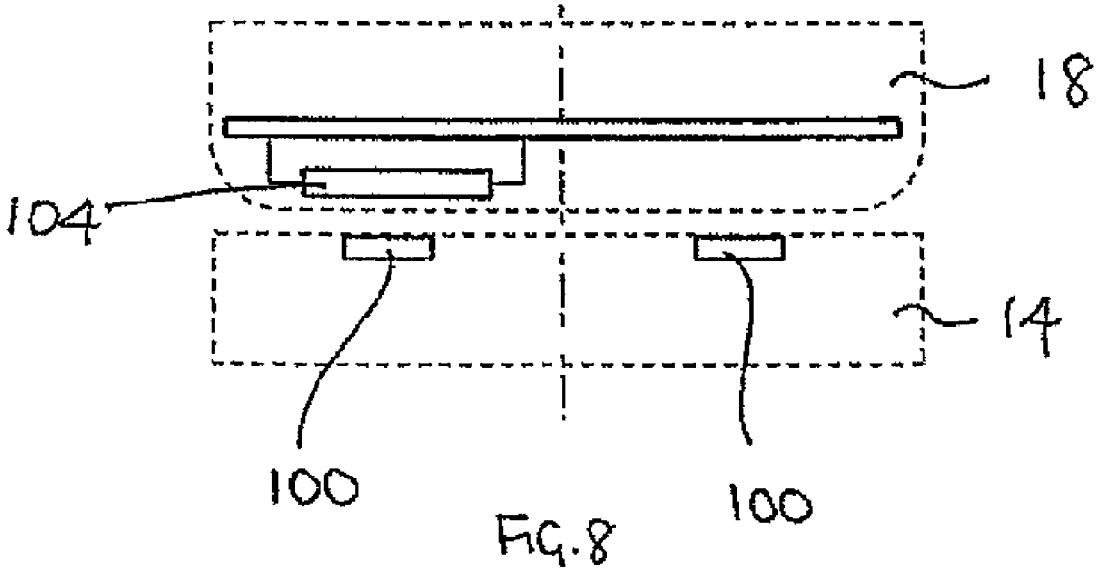
FIG. 8 is a schematic diagram for the purpose of illustrating the switching system.

FIGS. 8 and 9 illustrate the operation of the rotatable switch. In particular, with reference to FIG. 9, the docking station 14 incorporates two magnets 100 located inside the docking station near its upper surface and disposed diametrically opposite each other relative to the centre of the docking station. The base of the lamp unit contains circuit including a microcontroller 102, a reed switch 104 switching transistor 106 which is all connected to the lamp 56.

For charging, the lamp unit is placed on the docking station as shown in FIG. 1*a*. With reference to FIG. 1*b*, the docking station defines an upstanding ring 130 in the centre of which are located positive and negative contacts 132 and 134 respectively. One contact 132 is centrally located in the ring, the other is offset from the centre. The bottom of the lamp unit defines a corresponding ring shaped recess 136 (refer to FIG. 6) which locates over the upstanding ring 130 and around which the lamp unit may rotate. The polarity of the contacts may be varied depending on the type of DC power supply connected to the docking station 14. It is envisaged that two types of power supply with opposite polarity DC output may be provided. A relatively smaller rating unit will be provided for use with a single lamp particularly for domestic use. A relatively larger capacity unit is envisaged for use with up to five lamps for commercial use. By default, the reed switch will be ignored when the lamp is in use with the commercial DC power supply unit.

Turning the lamp unit 12 around on the base causes the magnets 100 to periodically pass close to the reed switch which activates the reed switch (every time the lamp rotates through 180°. The microcontroller detects this signal and uses it to vary the pulse width modulation drive to the switching transistor 106. This in turn, changes the brightness of the lamp by adjusting the operating duty cycle of the lamp. The microcontroller can be programmed to turn the light on and off when rotated. This allows, for example the lamp to be used on the docking station, if desired, and switched off when not required by simply turning the lamp.

Turning back to FIG. 1*a* window 120 is defined in the docking station. Red, blue and green LEDs may be located behind the window and illuminated depending on the status of the docking station/lamp unit, i.e. whether there is power to the docking station, whether the lamp unit is charging and/or whether the light is in operation and whether the lamp unit is fully charged. In particular, the window will glow blue when power is supplied to the docking station, changes to red when the lamp unit is properly docked with the docking station and is charging and will turn to green when the lamp is fully charged. The LEDs are controlled by a circuit measuring the current supply to the lamp unit.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A rechargeable lamp unit comprising a base and a rechargeable power source carried in or on the base and a telescopic stem which is extendible between a first length and at least a second relatively longer length and which extends upwardly from the base and including a light emitting device located on a top of the telescopic stem or a socket for receiving such a device wherein the telescopic stem comprises a first hollow portion which extends upwardly from the base defining an open upper end and a second stem portion slidably located in the first hollow portion and wherein the second stem portion defines a series of spaced apart recesses extending along one side and wherein a cantilevered arm carried at the upper end of the first hollow portion defines a protrusion at one end which is adapted to locate in one of the recesses to set the height of the stem.

2. A rechargeable lamp unit as claimed in claim 1 further comprising: a separate docking station including means for connection to a source of electrical power and meals for receiving the lamp unit for charging of the rechargeable power source, the base of the lamp unit and the docking unit being configured such that the lamp unit may be rotated on the docking station wherein rotation of the lamp with respect to the docking station operates switches for turning the light source within the lamp unit ON or OFF, further including a control circuit controlling the operation of the light source, wherein one or more magnets are provided in the docking station and a reed switch is provided adjacent the base of the lamp unit, in an arrangement such that rotation of the lamp unit on the docking station causes the magnet to come into close proximity with the reed switch, switching the reed switch ON and providing an input to the control circuit which controls the brightness of the light source, and wherein continued rotation of the lamp unit causes the magnet to come into close proximity with the reed switch a second time further changing the brightness of the light source.

3. A rechargeable lamp system as claimed in claim 2, wherein the rechargeable power source includes a battery assembly which defines a central aperture which in use, fits over and around the stem so that the battery assembly is located above the base surrounding the stem and below the light source.

4. A rechargeable lamp system as claimed in claim 3 and wherein a cavity is defined in the base of the lamp unit underneath the battery and wherein the control circuit is located in the cavity.

5. A rechargeable lamp system as claimed in claim 2 wherein the lamp unit defines a illuminable indicator means which changes colour depending on the status of the lamp and docking station.

6. A rechargeable lamp system as claimed in claim 5 wherein the illuminable indicator means is arranged to glow in one colour when power is supplied to the docking station, is arranged to change to a different colour when the lamp unit is properly docked with the docking station and is either charging or if the light emitting device is switched ON, and is arranged to change to a different colour when the lamp is fully charged.

7. A rechargeable lamp system as claimed in claim 6 wherein the illuminable indicator means includes a plurality of differently coloured LEDs and the switching ON or OFF of the differently coloured LEDs is controlled by a circuit measuring the current supply of the lamp unit.

8. A rechargeable lamp system comprising a lamp unit including a base, a light source and a rechargeable power source for supplying power to the light source; and a separate docking station including means for connection to a source of electrical power and means for receiving the lamp unit for charging of the rechargeable power source, the base of the lamp unit and the docking unit being configured such that the lamp unit may be rotated on the docking station wherein rotation of the lamp with respect to the docking station operates switches for turning the light source within the lamp unit ON or OFF; further including a control circuit controlling the operation of the light source, wherein one or more magnets are provided in the docking station and a reed switch is provided adjacent the base of the lamp unit, in an arrangement such that rotation of the lamp unit on the docking station causes the magnet to come into close proximity with the reed switch, switching the reed switch ON and providing an input to the control circuit which controls the brightness of the light source and wherein continued rotation of the lamp unit causes the magnet to come into close proximity with the reed switch a second time further changing the brightness of the light source.

9. A rechargeable lamp system as claimed in claim 8 wherein the further change in the brightness of the light source comprises switching the light source OFF.

10. A rechargeable lamp system as claimed in claim 8 wherein the lamp unit further includes a stem, and wherein the light source is located at or near a top of the stem and wherein the stem is extendible in height between a first length and at least a second relatively longer length.

11. A rechargeable lamp system as claimed in claim 8 wherein the docking station defines an upstanding ring inside which are located positive and negative contacts and the base of the lamp defines an aperture which locates over the circular ring.

12. A rechargeable lamp system as claimed in claim 8 or claim 11 wherein the lamp unit provides a plurality of preset brightness settings when ON.

13. A rechargeable lamp system as claimed in claim 8, wherein the lamp unit further includes a stem, the light source being disposed at or near the top of the stem, wherein the rechargeable power source includes a battery assembly which defines a central aperture which in use, fits over and around the stem so that the battery assembly is located above the base surrounding the stem and below the light source.

14. A rechargeable lamp system as claimed in claim 13 and wherein a cavity is defined in the base of the lamp unit underneath the battery and wherein the control circuit is located in the cavity.

15. A rechargeable lamp system as claimed in claim 13 wherein a retention clip is provided which snap fits over the top of the battery and retains the same against the stem to secure the battery to the stem and the base of the lamp.

16. A rechargeable lamp system as claimed in claim 8 wherein the lamp unit defines a illuminable indicator means which changes colour depending on the status of the lamp and docking station.

17. A rechargeable lamp system as claimed in claim 16 wherein the illuminable indicator means is arranged to glow in one colour when power is supplied to the docking station, is arranged to change to a different colour when the lamp unit is properly docked with the docking station and is either charging or if the light emitting device is switched ON, and is arranged to change to a different colour when the lamp is fully charged.

18. A rechargeable lamp system as claimed in claim 17 wherein the illuminable 5 indicator means includes a plurality of differently coloured LEDs and the switching ON or OFF of the differently coloured LEDs is controlled by a circuit measuring the current supply to the lamp unit.

* * * * *